United States Patent [19]

Barr et al.

[11] Patent Number: 4,679,639

[45] Date of Patent: Jul. 14, 1987

[54] ROTARY DRILL BITS AND CUTTING ELEMENTS FOR SUCH BITS

[75] Inventors: John D. Barr, Cheltenham; Michael T. Wardley, Hardwicke, both of England

[73] Assignee: NL Petroleum Products Limited, Cheltenham, England

[21] Appl. No.: 676,696

[22] Filed: Nov. 30, 1984

[30] Foreign Application Priority Data

Dec. 3, 1983 [GB] United Kingdom ..... 8332343
Feb. 28, 1984 [GB] United Kingdom ..... 8405181

[51] Int. Cl.[4] ..... E21B 10/46
[52] U.S. Cl. ..... 175/329; 175/410
[58] Field of Search ..... 175/329, 410, 374, 413; 299/79, 91

[56] References Cited

U.S. PATENT DOCUMENTS

| | | | |
|---|---|---|---|
| 3,904,247 | 9/1975 | Ostrop | 299/91 |
| 4,073,354 | 2/1978 | Rowley et al. | 175/329 |
| 4,108,260 | 8/1978 | Bozarth | 175/410 |
| 4,109,737 | 8/1978 | Bovenkerk | 175/329 |
| 4,140,189 | 2/1979 | Garner | 175/329 |
| 4,156,329 | 5/1979 | Daniels et al. | 175/329 X |
| 4,200,159 | 4/1980 | Peschel et al. | 175/329 |
| 4,471,845 | 9/1984 | Jürgens | 175/329 |
| 4,529,048 | 7/1985 | Hall | 175/329 X |
| 4,593,777 | 6/1986 | Barr | 175/329 X |
| 4,624,830 | 11/1986 | Barr | 175/329 X |

FOREIGN PATENT DOCUMENTS

| | | | |
|---|---|---|---|
| 9315 | 8/1979 | European Pat. Off. . | |
| 32428 | 8/1981 | European Pat. Off. . | |
| 103391 | 3/1984 | European Pat. Off. | 175/329 |
| 3027990 | 3/1982 | Fed. Rep. of Germany | 175/410 |
| 1086110 | 4/1984 | U.S.S.R. | 175/329 |

*Primary Examiner*—Stephen J. Novosad
*Assistant Examiner*—Matthew Smith
*Attorney, Agent, or Firm*—Browning, Bushman, Zamecki & Anderson

[57] ABSTRACT

A cutting element for a rotary drill bit comprises a thin hard facing layer, defining a front cutting face, bonded to a less hard backing layer. The backing layer is of non-uniform thickness, for example is wedge-shaped, and is thicker adjacent the cutting edge of the facing layer than it is over the rest of the area of the facing layer. The rear surface of the backing layer of the cutting element is bonded to a surface on a carrier which is mounted in the bit body. The backing layer of the cutting element may be formed in two portions: a front portion which is bonded to the hard facing layer and a second, wedge-shaped portion which is bonded subsequently to the rear surface of the first portion.

26 Claims, 29 Drawing Figures

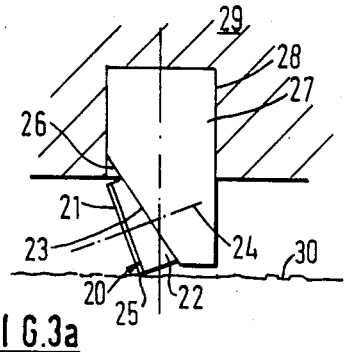
FIG.3a
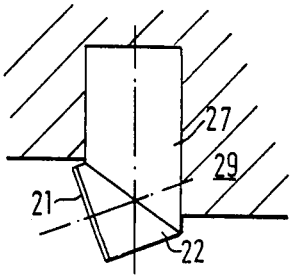
FIG.4a
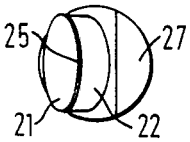
FIG.3b
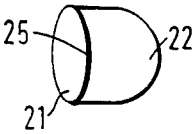
FIG.4b
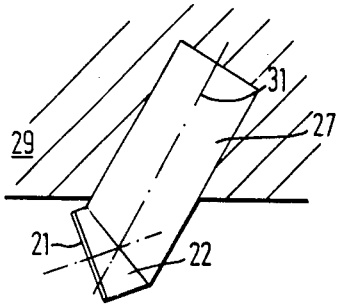
FIG.5a
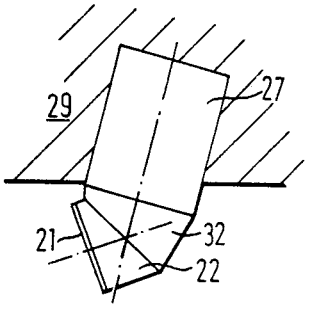
FIG.6a
FIG.5b
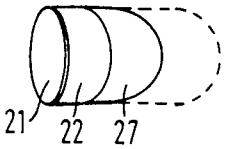
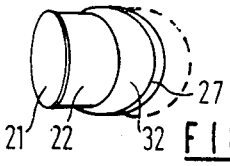
FIG.6b FIG.11a
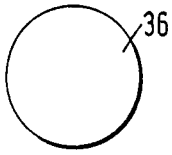
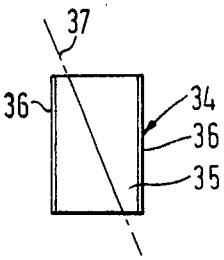
FIG.11b
FIG.12a
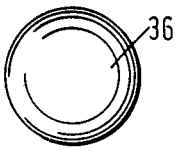
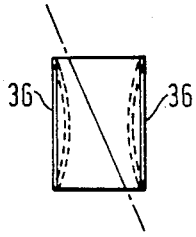
FIG.12b
FIG.13a
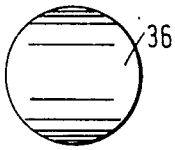
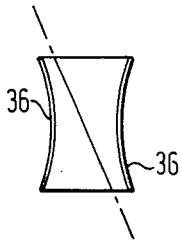
FIG.13b
FIG.14a
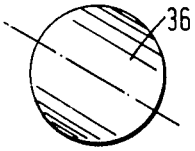
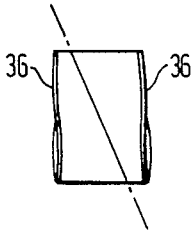
FIG.14b
FIG.15a
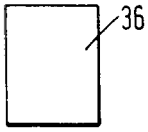
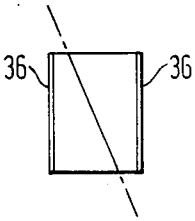
FIG.15b

ROTARY DRILL BITS AND CUTTING ELEMENTS FOR SUCH BITS

BACKGROUND OF THE INVENTION

The invention relates to rotary drill bits for use in drilling or coring deep holes in subsurface formations and, in particular, to a form of cutting element for use on such bits.

Rotary drill bits of the kind to which the invention relates comprise a bit body having a shank and an inner channel for supplying drilling fluid to the face of the bit. The bit body carries a plurality of so-called "preform" cutting elements. Each cutting element comprises a thin hard facing layer, which defines the front cutting face of the element, bonded to a less hard backing layer. For example, the hard facing layer may be formed of polycrystalline diamond or other superhard material, and the backing layer may be formed of cemented tungsten carbide. The two-layer arrangement of the cutting elements provides a degree of self-sharpening since, in use, the less hard backing layer wears away more easily than the harder cutting layer.

The preform cutting elements are usually mounted on the bit body by being bonded, for example, by brazing, to a carrier which may be in the form of a stud of tungsten carbide which is received and located in a socket in the bit body.

Examples of the use of such preform cutting elements, their manufacture and mounting on rotary drill bits are disclosed in U.S. Pat. Nos. 3,743,489, 3,745,623, 3,767,371, 4,098,362, 4,109,737 and 4,156,329.

Conventionally, the layers making up each cutting element are of uniform thickness, and the elements are most usually circular although other configurations are sometimes employed.

Although drill bits incorporating preform cutting elements of this kind are generally very effective, problems are often encountered through failure of the cutting elements by fracture or detachment from the bit when subjected to the very high stresses encountered during drilling. It is an object of the invention, therefore, to provide an improved form of cutting element which may be less susceptible to failure in use.

SUMMARY OF THE INVENTION

According to the invention a cutting element for a rotary drill bit comprises a thin hard facing layer, defining a front cutting face, bonded to a less hard backing layer, the backing layer being of non-uniform thickness and being thicker adjacent the cutting edge (as hereinafter defined) of the facing layer than it is over the rest of the area of the facing layer.

In this specification the cutting edge of the facing layer is defined as that edge thereof which is intended to engage, cut and/or abrade the formation being drilled when the cutting element is in use, mounted on a rotary drilling bit.

It is found that by making the backing layer thicker adjacent the cutting edge certain advantages may be obtained.

The orientation of the cutting element with respect to its carrier is normally determined by the required rake angle of the front cutting face of the element with respect to the surface of the formation. In cutting elements of uniform thickness this required rake angle of the cutting face will also determine the orientation of the surfaces of the backing layer and carrier which must be bonded together. It will be appreciated that the shear stress to which the bond is subjected in use will depend on the orientation of the bonded surfaces, and that an orientation which reduces the shear stress will also tend to reduce the likelihood of the bond failing. Depending on the precise configuration of the cutting element and the rear surface of its backing layer, increasing the thickness of the backing layer adjacent the cutting edge may be arranged to have the effect of altering the orientation of the surfaces to be bonded in such manner that the shear stress on the bond in use, and thus its tendency to fail, is decreased.

The aforementioned carrier for the cutting element serves as a rigid support for it in order to reduce the risk of the element fracturing through bending. The material of the carrier therefore normally requires a high modulus of elasticity. By increasing the thickness of the backing layer of the element adjacent the cutting edge, however, the element is rendered stronger at the region of highest stress and this may permit the carrier to be formed of a material of lower modulus of elasticity, thus saving cost and giving better wear characteristics.

Due to the high temperatures involved, the hard facing layer of the cutting element may be susceptible to thermal damage when the element is being bonded to its carrier, for example by so-called "LS bonding" of the backing layer to a surface of the carrier. (LS bonding is described in U.S. Pat. No. 4,225,322.) By increasing the thickness of the backing layer adjacent the cutting edge, the distance of the facing layer from the surfaces being bonded is increased thus providing the possibility of minimising thermal damage to the cutting edge, which is the most critical area of the facing layer.

In some configurations, to be described, providing a cutting element of non-uniform thickness may allow the contour of the cutting element to be matched more closely to the contour of the carrier to which it is bonded, and this may improve the flow characteristics of the drilling fluid around the cutting element and the carrier to provide better control of turbulence in the drilling fluid. Furthermore, having cutting elements of uniform thickness has hitherto tended to impose certain limitations on the possible geometry of the carriers to which the cutting elements are bonded, due, as mentioned above, to the necessity of arranging the front cutting face of the elements at a required rake angle. By making the backing layer thicker adjacent the cutting edge, greater flexibility in possible shapes and orientations of the carrier may be obtained.

The invention may also provide advantages in the manufacture of the cutting elements. Preform cutting elements are normally formed under massive pressure in a press, the operation of which is very costly. The cost of forming each cutting element may be reduced by increasing the number of elements formed in each press operation. In one embodiment of the invention, to be described, two cutting elements are formed by first forming an intermediate structure in the press and then cutting the intermediate structure into two to form the cutting elements. The volume occupied in the press by the intermediate structure may be less than the total volume occupied by two separate cutting elements, and this may allow the number of cutting elements formed by each press operation to be increased, thus lowering the unit cost.

Although the hard facing layer and less hard backing layer may be formed from any suitable materials, as previously mentioned the facing layer may be formed of polycrystalline diamond and the backing layer may be formed of cemented tungsten carbide.

Preferably the thickness of the backing layer varies continuously and smoothly across the area of the cutting face. The general plane of the facing layer may be disposed generally at right angles to the central axis of the cutting element and in this case, the general plane of the rear surface of the backing layer may be inclined at an angle of less than 90° to the central axis so as to provide the required variation in thickness. The rear surface of the backing layer is preferably substantially flat so that the backing layer is generally wedge-shaped in cross-section.

The facing layer may also be flat, but the invention includes within its scope arrangements where the facing layer is of other surface configurations, for example where the facing layer is part-cylindrical or part-spherical so as to provide a concave or convex front face to the facing layer.

The cutting element as a whole may be substantially circular in cross section and may, for example, be in the form of a portion of a cylinder.

The invention includes within its scope a cutting structure, for a rotary drill bit, comprising in combination a cutting element of any of the kinds referred to above and a carrier for mounting on the drill bit, the rear surface of the backing layer of the cutting element being bonded to a surface of the carrier.

The carrier, which may be formed from tungsten carbide, may be in the form of a cylindrical stud having a surface inclined at less than 90° to the central axis of the stud and to which the rear surface of the backing layer of the cutting element is bonded.

The invention also includes within its scope a rotary drill bit comprising a bit body having a shank and an inner channel for supplying drilling fluid to the face of the bit, the bit body carrying a plurality of cutting elements of any of the kinds referred to above.

The invention also provides a method of forming a cutting element of any of the kinds referred to above, the method comprising the steps of forming an intermediate structure comprising two hard facing layers bonded to opposite faces of a central less hard layer, and then dividing the central layer of the intermediate structure along a plane inclined at less than 90° to the central axis of the intermediate structure, thereby to form two cutting elements, the cutting face of each of which is provided by one of said hard facing layers and the backing layer of each of which is provided by one part of the divided central layer.

In all of the arrangements described above, the backing layer of non-uniform thickness is preferably bonded in one piece to the thin hard facing layer, the bonding taking place in conventional manner during the formation of the cutting element in a press. However, there may also be advantage in forming the backing layer in two portions: a first portion which is bonded to the hard facing layer in the forming press, in conventional manner, and a second portion which is bonded subsequently to the rear surface of the first portion, for example by "L S bonding". In this case the first portion would normally be of uniform thickness and the second portion would be of non-uniform thickness, so that when bonded to the first portion it would give a total backing layer of non-uniform thickness in accordance with the present invention. For example, the second portion of the backing layer may be generally wedge-shaped in cross-section so that when combined with the uniform-thickness first portion the backing layer as a whole becomes wedge-shaped.

The bonding of the second portion of the backing layer to the first portion may be effected simultaneously with the bonding of the second portion of the backing layer to the carrier.

Such an arrangement may provide all the advantages of the invention referred to earlier, except that the advantage of reduction in shear stress along the bond between the backing layer and carrier will be offset by the fact that the bond between the two portions of the backing layer will be subject to the same shear stress as at the rear of a conventional, uniform thickness cutting element.

The two portions forming the backing layer are preferably of similar material, e.g. cemented tungsten carbide, of the same hardness although materials of different hardness may also be used provided that both are less hard than the facing layer of the cutting element to provide the desired self-sharpening effect.

Forming the backing layer in two portions has the advantage that the first portion, bonded to the hard facing layer, may be thin, thus allowing a greater number of facing layer/first portion units to be packed into the high pressure forming press, and thus reducing unit cost. The second, rear portion of the backing layer may be pre-formed by any conventional method, depending on the material employed.

The invention also includes within its scope arrangements in which the hard facing layer and backing layer are separately preformed and then bonded together subsequently. Hitherto, where the hard facing layer has been formed from polycrystalline diamond, it has been necessary to bond the diamond layer to the backing layer during formation of the two layers in the high pressure forming press. This was because the polycrystalline diamond material was not thermally stable at the temperatures which would be required to bond it to a backing layer subsequently. Recent developments have, however, resulted in the production of thermally stable polycrystalline diamond materials which can withstand such higher temperatures. Accordingly, a layer of such material may be separately preformed and subsequently bonded to a separately formed backing layer of non-uniform thickness to provide a cutting element in accordance with the present invention and having at least some of the advantages thereof.

BRIEF DESCRIPTION OF THE DRAWINGS

FIG. 3(*a*) is a diagrammatic section through a cutting element according to the invention mounted on a stud in a drill bit body.

FIG. 3(*b*) is an end elevation of the assembly shown in FIG. 3(*a*),

FIGS. 4(*a*) and (*b*) to FIGS. 8(*a*) and (*b*) are similar views of alternative arrangements.

FIGS. 11(*a*) to 15(*a*) are end elevations of various forms of cutting element according to the invention, FIGS. 11(*b*) to 15(*b*) are corresponding side elevations of the intermediate structures from which the respective cutting elements are formed.

DETAILED DESCRIPTION OF PREFERRED EMBODIMENTS

Figure 1:
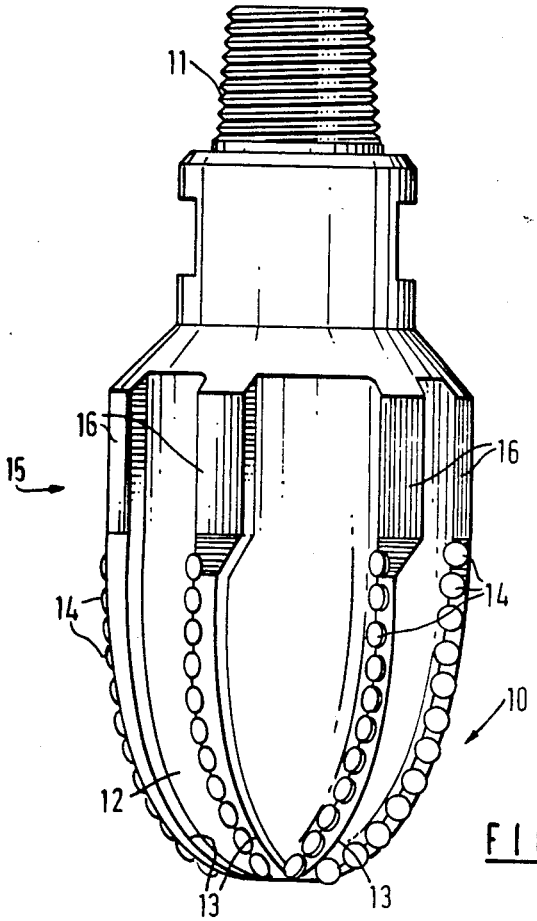
FIG. 1 is a side elevation of a typical drill bit in which cutting elements according to the invention may be used.
Figure 2:
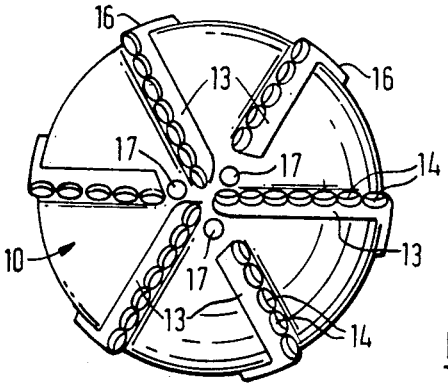
FIG. 2 is an end elevation of the drill bit shown in FIG. 1.

FIGS. 1 and 2 show a full bore drill bit of a kind to which cutting elements of the present invention are applicable.

The bit body 10 is typically formed of tungsten carbide matrix infiltrated with a binder alloy, and has a threaded shank 11 at one end for connection to the drill string.

The operative end face 12 of the bit body is formed with a number of blades 13 radiating from the central area of the bit and the blades carry cutting members 14 spaced apart along the length thereof.

The bit has a gauge section 15 including kickers 16 which contact the walls of the bore hole to stabilise the bit in the bore hole. A central channel (not shown) in the bit body and shank delivers drilling fluid through nozzles 17 in the end face 12, in known manner.

It will be appreciated that this is only one example of the many possible variations of the type of bit to which the invention is applicable, including bits where the body is formed from steel.

Each cutting member 14 comprises a preform cutting element mounted on a carrier in the form of a stud which is located in a socket in the bit body. Conventionally, each preform cutting element is usually circular and each comprises a thin facing layer of polycrystalline diamond bonded to a backing layer of tungsten carbide, both layers being of uniform thickness. The rear surface of the backing layer of each cutting element is bonded, for example by brazing, to a suitably orientated surface on the stud, which may also be formed from tungsten carbide.

FIGS. 3(*a*) and 3(*b*) show a modified cutting member incorporating a cutting element in accordance with the invention. The cutting element 20 itself is circular and comprises a thin hard facing layer 21 of polycrystalline diamond and thicker backing layer 22 of cemented tungsten carbide. The facing layer 21 extends at right angles to the central axis 24 of the cutting element. According to the invention, however, the backing layer 22 is not of uniform thickness, and the rear surface 23 of the backing layer is inclined at an angle of less than 90° to the central axis 24 of the cutting element. Thus the backing layer 22 is generally wedge-shaped so as to be of increased thickness adjacent the cutting edge of the cutting element, which is indicated at 25.

The inclined rear surface 23 of the backing layer 22 is bonded to an inclined surface 26 on a generally cylindrical tungsten carbide stud 27 which is mounted in a socket 28 to the bit body 29.

The orientation of the cutting element 20 is determined by the required rake angle of the front cutting layer 21 with respect to the formation 30 being cut or abraded. The main forces acting on the cutting element during drilling are the drag load acting in a direction generally parallel to the surface 30 of the formation and the "weight on bit" load acting at right angles thereto. Although the forces acting on the cutting element during drilling are variable and difficult to predict or calculate with accuracy, it is believed that the resultant of the forces acts in such a direction that the resulting shear stress along the bond line between the two surfaces 23 and 26 may be reduced by reducing the angle which the bond line makes with respect to the surface of the formation. With a conventional cutting element of uniform thickness the angle of this bond line is necessarily equal to the angle of rake of the cutting face, and is thus predetermined, but the wedge-shaped backing layer of the arrangement shown in FIGS. 3(*a*) and 3(*b*) reduces the angle of the bond line with respect to the formation while maintaining the same rake angle for the cutting face. This advantage is to be obtained by all the embodiments of the invention hereinafter described.

Using a conventional cutting element of uniform thickness, a smooth junction between the cutting element and the carrier stud may sometimes only be obtained by special shaping of the stud. More often the cutting element is simply bonded to part of an inclined surface of larger area as in the embodiment in FIGS. 3(*a*) and 3(*b*). However, by inclining the rear surface of the backing layer at the same angle as the inclined surface on the carrier stud 27, and making the stud of the same diameter as the cutting element, as shown in FIGS. 4(a) and 4(b), the surface areas to be bonded can be matched exactly in area and shape, thus improving the flow around the cutting structure and also giving fewer areas of stress concentration. FIGS. 5(*a*) and 5(*b*) show an alternative arrangement, similar to the arrangement of FIGS. 4(a) and 4(b) but in this case the central axis 31 of the stud 27 is inclined with respect to the surface of the formation instead of being at right angles thereto as in the previously described arrangements. The invention permits greater flexibility in the orientation of the stud since by inclining the rear surface of the backing layer 22 to a suitable angle the bond surfaces between the element and stud may be orientated as required, which in turn allows the stud to be orientated as required.

FIGS. 6(*a*) and 6(*b*) show an alternative arrangement in which the stud 27 is mostly of greater diameter than the cutting element but is integrally formed with a neck 32 to provide a smooth junction with the cutting element.

Figure 7A:
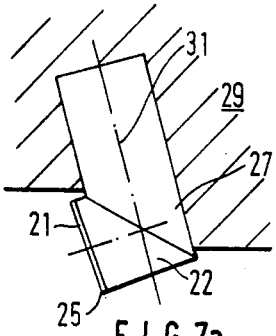
Figure 7B:
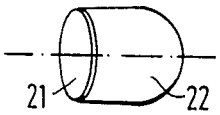

FIGS. 7(*a*) and 7(*b*) show an arrangement in which the central axis 31 of the stud 27 is inclined forwardly as it extends away from the formation.

Figure 8A:
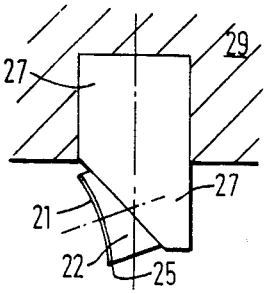
Figure 8B:
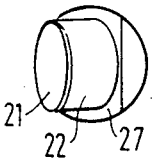

Although the front facing layer of the preform cutting element is usually flat as in the above described embodiments, it is also known to provide cylindrically or spherically concave facing layers and FIGS. 8(*a*) and 8(*b*) show a cutting element according to the invention having a cylindrically concave layer.

Figure 9:
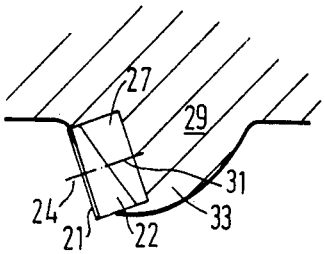
FIGS. 9 and 10 are views similar to that of FIG. 3A showing, respectively, two more alternative embodiments.

FIG. 9 shows an arrangement in which the carrier for the cutting element 20 is a small cylindrical stud 27 which is coaxial with the cutting element 20, the cutting structure being received in a socket in a blade 33 formed on the bit body 29.

Figure 10:
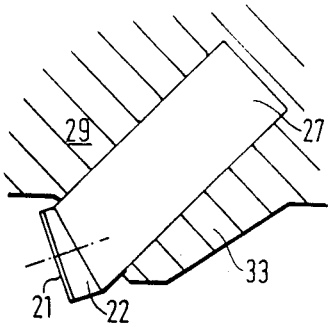

FIG. 10 shows a further alternative arrangement where the stud 27 is located in a socket in a blade 33 formed on the bit body.

In addition to the advantages referred to above regarding reduction in shear stress and orientation of the carrier stud, all of the cutting elements described above may also provide the other advantages referred to in the introduction to the specification.

Referring to FIGS. 11(*a*) and 11(*b*), two cutting elements in accordance with the invention may be formed by first forming in a press an intermediate structure 34 comprising a central layer 35 of cemented tungsten carbide to the opposite ends of which are bonded thin facing layers 36 of polycrystalline diamond. After the intermediate structure has been formed in the press, it is divided along an inclined cutting plane, indicated at 37, to form two separate cutting elements each of which is in accordance with the invention. The angle of inclination of the cutting plane 37 may, of course, be varied according to the variation in thickness of the backing layer required. As previously mentioned, besides being a particularly convenient method of forming cutting elements according to the invention, this method has the advantage that the volume within the press required for the intermediate structure shown in FIG. 11(*b*) will be less than that required for two parallel-faced cutting elements of the same maximum thickness as the elements according to the invention, and this may therefore allow the total number of cutting elements formed in the press at any one time to be increaed, with a consequent reduction in unit cost.

FIGS. 12(*a*) and (*b*) to FIGS. 15(*a*) and (*b*) show other possible configurations for the intermediate structures and resulting cutting elements. In FIGS. 12(*a*) and (*b*) the diamond facing layers are part-spherical and concave whereas in FIGS. 13(*a*) and (*b*) the facing layers are part-cylindrical. FIGS. 14(*a*) and (*b*) show an arrangement in which the cutting plane 37 is angularly rotated about the axis of the intermediate structure with respect to the part-cylindrical concave facing layers.

Figure 16:
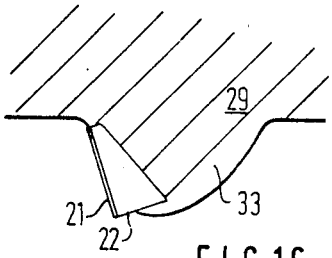
FIGS. 16 to 18 are diagrammatic sections through further cutting elements and their mountings.

The embodiment of the invention shown in FIG. 16 is similar to that shown in FIG. 9, but in this case the cutting element 22 is not mounted on a stud or other carrier but is itself secured to the matrix 29. For example, the element may be secured to the matrix by a low temperature braze which has a lower shear strength than the LS bond between a cutting element and its carrier, such as a stud. However, the configuration of cutting element according to the invention allows this, in view of the reduction in shear stress which it provides, as mentioned earlier.

The arrangement of FIG. 16 is less costly than the arrangement of FIG. 9 since no LS bonding is necessary. It may also be less costly than known arrangements where parallel-sided cutting elements are set directly in the matrix bit body, since the element is of smaller volume than a parallel-sided element of the same maximum thickness and, as previously mentioned, this may reduce the cost of production of the elements by allowing more elements to be formed in each press operation.

In any case, since the wedge-shaped element 22 of FIG. 16 does not project into the blade 33 to the same extent as the structure of FIG. 9 or the equivalent parallel-sided element, it does not weaken the blade 33 to the same extent. The matrix of the blade 33 is thus stronger and less liable to fracture in use of the bit.

Although all the above described arrangements show circular cutting elements, it will be appreciated that the invention is equally applicable to cutting elements of other shapes and FIGS. 15(*a*) and (*b*) show, by way of example, the formation of cutting elements of rectangular cross-section.

In all of the above described arrangements the cutting elements are so mounted on the bit body that the thickest part of the backing layer is adjacent the cutting edge, that is to say, the edge of the facing layer which will, in use, cut and/or abrade the formation.

Although in all the above described arrangements the rear surface of the backing layer has been shown as flat and inclined to provide the increased thickness adjacent the cutting edge, it will be appreciated that at least certain of the advantages of the invention will be achieved by rear surfaces of other contour. For example, the rear surface of the backing layer may be curved, stepped or may otherwise comprise areas arranged at an angle to one another.

In all of the arrangements described above in relation to the drawings, the backing layer 22 of the cutting element is in one piece and is formed simultaneously with the diamond facing layer in the diamond bonding press. As previously mentioned, however, the invention also includes within its scope arrangements in which the backing layer is formed in two portions: a first portion bonded to the diamond layer in the diamond bonding press, and a second portion which is bonded to the first portion subsequently.

FIGS. 9 and 10 each show in dotted line, indicated at 40, a possible location for the bond surface between the two portions of the backing layer 22. Although the bond surface is shown as being parallel to the front cutting face of each cutting element, it could instead be at an angle to that face. For example, if the bond surface were so inclined to the cutting face as to render the first portion of the backing layer, like the second portion, of greater thickness adjacent the cutting edge, this would reduce the shear stress along the bond surface between the two portions of the backing layer.

In any of the described arrangements, also, the facing layer 21 may be a separately preformed, thermally stable diamond layer which is subsequently bonded to the separately formed backing layer 22.

In all of the arrangements described above where the backing layer 22 is formed in a single piece, the angled rear surface of the cutting element is shown as being formed entirely on the backing layer. Alternatively, however, the rear angled surface could extend through the front cutting face of the element, as shown in the arrangement of FIG. 17, to provide a "feathered" edge 41 to the cutting face.

As previously mentioned, one of the advantages of the present invention is that the increased thickness of the backing layer adjacent the cutting edge reduces the possibility of thermal damage to the cutting edge, which is the most critical area of the facing layer, when the cutting element is being bonded to its carrier. Since, according to the invention, the backing layer is thinner remote from the cutting edge, it follows that the portion of the front cutting layer remote from the cutting edge will be subject to the highest temperatures during bonding. The material of the cutting layer, such as polycrystalline diamond, is very thermally conductive so that heat will be conducted along the cutting layer itself towards the cutting edge. To minimise this heat transfer, the cutting layer may be formed with a straight transverse slot a short distance from the feathered edge of the cutting layer, as indicated, for example, at 42 in FIG. 18. This slot 42 acts as a thermal break and thus reduces further the risk of thermal damage to the cutting edge 25 due to thermal conduction along the cutting layer. The portion 43 of the cutting layer remote from the cutting edge 25 does not perform any useful function and could be removed entirely. Although, in FIG. 18, the provision of the slot 42, or removal of the portion 43, is shown in a "feathered" cutting element of the kind described in relation to FIG. 17, it will be appreciated that similar advantage may also be obtained by providing such a slot, or removing a portion of the cutting layer, in any of the other embodiments of the invention previously described.

Figure 17:
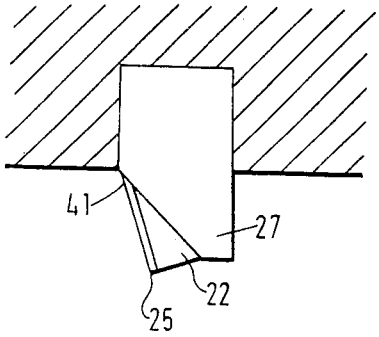
Figure 18:
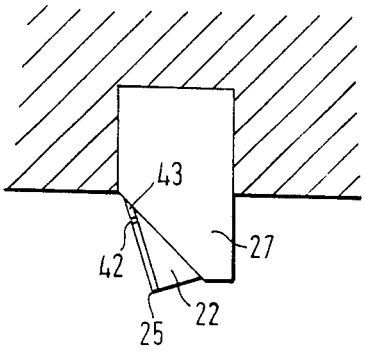

The "feathered" form of cutting element shown in FIGS. 17 and 18 may conveniently be formed using the method described in relation to FIGS. 11*a* and 11*b*, but in this case, the cutting plane 37, instead of lying entirely within the central layer 35, will be angled to intercept the facing layers 36, so that the facing layer of each finished cutting element has a straight, "feathered" edge along the line where it was intercepted by the cutting plane 37.

It will be appreciated that the methods described in relation to FIGS. 11*a* to 15*b* are not the only ways of forming cutting elements in accordance with the invention. For example, a cutting element according to the invention may also be formed by taking a conventional parallel-sided cutting element and then shaping the rear face by a suitable process, such as laser-cutting.

The method described in relation to FIGS. 11*a* to 15*b* is particularly suitable for forming cutting elements of varying thickness, according to the invention. However, the method may also be used to form conventional cutting elements in which the opposite faces of the cutting element are parallel. In this case the cutting plane 37 will be substantially parallel to the thin facing layers 36 of the intermediate structure 34, and the two cutting elements then formed will be of constant thickness. The two cutting elements may be made of the same thickness by locating the plane 37 centrally between the two facing layers, or they may be made of different thickness by displacing the cutting plane from the central position.

In those arrangements where the cutting element is mounted on a carrier, for example in the form of a stud located in a socket in the bit body, the carrier may be formed from a material, such as steel, which is softer than the material of the backing layer of the cutting element.

We claim:

1. A cutting element for a rotary drill bit comprising a thin hard facing layer, defining a front cutting face, bonded to a less hard backing layer, defining a rear face and lateral surfaces, the backing layer being fabricated of non-uniform thickness, thicker adjacent the cutting edge of the facing layer than it is over the rest of the area of the facing layer, wherein the general plane of the facing layer is disposed generally at right angles to the central axis of the cutting element, and the general plane of the rear surface of the backing layer is inclined at an angle of less than 90° to the central axis so as to provide the required variation in thickness.

2. A cutting element according to claim 1, wherein the facing layer is formed of polycrystalline diamond and the backing layer is formed of cemented tungsten carbide.

3. A cutting element according to claim 1, wherein the thickness of the backing layer varies continuously and smoothly across the area of the cutting face.

4. A cutting element according to claim 3, wherein the rear surface of the backing layer is substantially flat so that the backing layer is generally wedge-shaped in cross-section.

5. A cutting element according to claim 1, wherein the facing layer is substantially flat.

6. A cutting element according to claim 1, wherein the facing layer is shaped to provide a concave front face to the facing layer.

7. A cutting element according to claim 1, wherein the cutting element as a whole is substantially circular in cross-section.

8. A cutting element according to claim 1, wherein the backing layer is formed in two portions: a first portion which is bonded to the hard facing layer in a forming press, and a second portion which is bonded subsequently to the rear surface of the first portion.

9. A cutting element according to claim 8, wherein the first portion is of uniform thickness and the second portion is of non-uniform thickness, so that when bonded to the first portion there is provided a total backing layer of non-uniform thickness.

10. A cutting element according to claim 9, wherein the second portion of the backing layer is generally wedge-shaped in cross-section so that when combined with the uniform-thickness first portion the backing layer as a whole becomes wedge-shaped.

11. A cutting element according to claim 8, wherein the two portions forming the backing layer are of similar material of the same hardness.

12. A cutting structure, for a rotary drill bit, comprising in combination a cutting element comprising a thin hard facing layer, defining a front cutting face, bonded to a less hard backing layer, defining a rear face and lateral surfaces, the backing layer being of non-uniform thickness and being thicker adjacent the cutting edge of the facing layer than it is in the area of the facing layer diametrically opposed to the cutting edge, and a carrier for mounting on the drill bit, the rear surface of the backing layer of the cutting element being bonded to a surface of the carrier.

13. A cutting structure according to claim 12, wherein the carrier is formed from tungsten carbide.

14. A cutting structure according to claim 12, wherein the carrier is formed from a material which is softer than the backing layer of the cutting element.

15. A cutting structure according to claim 14, wherein the carrier is formed from steel.

16. A cutting structure according to claim 12, wherein the carrier is in the form of a cylindrical stud having a surface inclined at less than 90° to the central axis of the stud and to which the rear surface of the backing layer of the cutting element is bonded.

17. A cutting structure according to claim 16, wherein the cutting element is co-axial with the cylindrical stud, the angle of inclination of the surface on the stud being equal to the angle of inclination of the rear surface of the cutting element.

18. A rotary drill bit comprising a bit body having a shank and an inner channel for supplying drilling fluid to the face of the bit, the bit body carrying a plurality of cutting elements, each cutting element comprising a thin hard facing layer, defining a front cutting face, bonded to a less hard backing layer, defining a rear face and lateral surfaces, the backing layer being of non-uniform thickness and being thicker adjacent the cutting edge of the facing layer than it is in the area of the facing layer diametrically opposed to the cutting edge.

19. A rotary drill bit comprising a bit body having a shank and an inner channel for supplying drilling fluid to the face of the bit, the bit body carrying a plurality of cutting structures, each comprising in combination a cutting element comprising a thin hard facing layer, defining a front face bonded to a less hard backing layer, defining a rear face and lateral surfaces, the backing layer being of non-uniform thickness and being thicker adjacent the cutting edge of the facing layer than it is in the area of the facing layer diametrically opposed to the cutting edge, and a carrier for mounting on the drill bit, the rear surface of the backing layer of the cutting element being bonded to a surface of the carrier.

20. A cutting element according to claim 1 wherein said lateral surfaces are disposed generally parallel to the central axis of the cutting element and generally perpendicular to said front face.

21. A cutting structure according to claim 12 wherein the general plane of the facing layer is disposed generally at right angles to the central axis of the cutting element and the general plane of the rear surface of the backing layer is inclined at an angle of less than 90° to the central axis so as to provide the required variation in thickness.

22. A rotary drill bit according to claim 18 wherein the general plane of the facing layer is disposed generally at right angles to the central axis of the cutting element and the general plane of the rear surface of the backing layer is inclined at an angle of less than 90° to the central axis so as to provide the required variation in thickness.

23. A rotary drill bit according to claim 22 wherein said lateral surfaces are disposed generally parallel to the central axis of the cutting element and generally perpendicular to said front face.

24. A rotary drill bit according to claim 19 wherein said lateral surfaces are disposed generally parallel to the central axis of the cutting element and generally perpendicular to said front face.

25. A rotary drill bit according to claim 24 wherein the general plane of the facing layer is disposed generally at right angles to the central axis of the cutting element and the general plane of the rear surface of the backing layer is inclined at an angle of less than 90° to the central axis so as to provide the required variation in thickness.

26. A rotary drill bit according to claim 21 wherein said lateral surfaces are disposed generally parallel to the central axis of the cutting element and generally perpendicular to said front face.

* * * * *